US006395392B1

(12) United States Patent
Gownder

(10) Patent No.: US 6,395,392 B1
(45) Date of Patent: May 28, 2002

(54) BICOMPONENT FIBERS OF ISOTACTIC AND SYNDIOTACTIC POLYPROPYLENE, METHODS OF MAKING, PRODUCTS MADE THEREOF

(75) Inventor: Mohan R. Gownder, Laporte, TX (US)

(73) Assignee: Fina Research, S.A., Feluy (BE)

( * ) Notice: Subject to any disclaimer, the term of this patent is extended or adjusted under 35 U.S.C. 154(b) by 0 days.

(21) Appl. No.: 09/575,872

(22) Filed: May 22, 2000

Related U.S. Application Data

(62) Division of application No. 08/901,358, filed on Jul. 28, 1997, now Pat. No. 6,074,590.

(51) Int. Cl.[7] ..... D01F 8/00

(52) U.S. Cl. ..... 428/370; 428/373; 428/374

(58) Field of Search ..... 428/370, 373, 428/374

(56) References Cited

U.S. PATENT DOCUMENTS 5,478,646 A * 12/1995 Asanuma et al. ..... 428/373
6,207,600 B1 * 3/2001 Nakajima et al. ..... 428/373

* cited by examiner

*Primary Examiner*—N. Edwards
(74) *Attorney, Agent, or Firm*—Gilbreth & Associates

(57) ABSTRACT

Bicomponent fibers of isotactic polypropylene and syndiotactic polypropylene, methods of making such fibers and products made thereof.

13 Claims, 4 Drawing Sheets

( a ) Side - by - side

Component 1 Component 2

( b ) Core - sheath

Component 1 Component 2

BICOMPONENT FIBERS OF ISOTACTIC AND SYNDIOTACTIC POLYPROPYLENE, METHODS OF MAKING, PRODUCTS MADE THEREOF

This application is a divisional of Ser. No. 08/901,358 filed Jul. 28, 1997, now U.S. Pat. No. 6,074,590.

BACKGROUND OF THE INVENTION

1. Field of the Invention

The present invention relates to fibers, methods of making fibers and to products made thereof. In another aspect, the present invention relates to polypropylene fibers, to methods of making such polypropylene fibers, and to products made from such polypropylene fibers. In even another aspect, the present invention relates to fibers comprising isotactic polypropylene and syndiotactic polypropylene, to methods of making such fibers comprising isotactic polypropylene and syndiotactic polypropylene, and to products made from such fibers comprising isotactic polypropylene and syndiotactic polypropylene. In still another aspect, the present invention relates to bicomponent fibers of isotactic polypropylene and syndiotactic polyproplene, to methods of making such bicomponent fibers of isotactic polypropylene and syndiotactic polyproplene, and to products made from such bicomponent fibers of isotactic polypropylene and syndiotactic polyproplene.

2. Description of the Related Art

Polypropylene with its high melting point, high strength, strain resistance and low cost has found employment in a wide variety of applications. Polypropylene fibers have found commercial use in synthetic carpets, geotextiles, textile fabrics, and the like. However, while polypropylene fibers have found wide application as carpet yarns, polypropylene fibers lack the elasticity and resiliency of other carpet fiber polymers, for example nylon. When loads such as furniture legs rest on polypropylene carpets for an extended period and removed, they leave their impression on the carpet in the form of packed carpet fibers. Poor resiliency prevents the packed fibers from bouncing back to their original configuration.

Bicomponent fibers comprise a first polymer component and a second component, with each component fused to the other along the fiber axis. The first and second components may by related as core and sheath, side by side, tipped, mocro denier and mixed fibers, and are generally produced utilizing a specially equipped fiber spinning machine. Examples of bicomponent fibers include nylon and polyurethane, and polypropylene and ethylene copolymers.

Bicomponent fibers of isotactic polypropylene and syndiotactic polypropylene are not known in the art.

Polypropylene has long been known to exist in several forms. Isotactic propylene (iPP) may generally be described as having methyl groups attached to the tertiary carbon atoms of successive monomeric units on the same side of a hypothetical plane through the polymer chain. Syndiotactic polypropylene (sPP) may generally be described as having methyl groups attached on alternating sides of the polymer chain.

Various combinations of syndiotactic and isotactic polypropylene have been proposed.

U.S. Pat. No. 4,939,202, issued Jul. 3, 1990 to Maletsky et al. discloses a barrier guard moisture-proof adhesive coating comprising isotactic and syndiotactic polypropylene. The amorphous polypropylene is said to be formed in minor amounts during the production of crystalline propylene using known sterospecific catalysts.

U.S. Pat. No. 5,124,404, issued Jun. 23, 1992 to Atwell et al. discloses the grafting of brominated monomeric units onto syndiotactic or isotactic polypropylene to form flame retardant polymer.

U.S. Pat. No. 5,269,807, issued Dec. 14, 1993 to Liu discloses. a suture fabricated from a blend of comprising syndiotactic and isotactic polypropylene.

E.P. Patent Application No. 0 622 410 A1, published Nov. 2, 1994, discloses melt blending of syndiotactic polypropylene and isotactic polypropylene to form useful medical articles.

E.P. Patent Application No. 0 650 816 A1, published May 3, 1995, discloses injection molding blends of syndiotactic polypropylene and isotactic polypropylene. The blend is made by melt blending syndiotactic polypropylene and isotactic polypropylene.

E.P. Patent Application No. 0 615 818 A2, published May 3, 1995, discloses a method of forming a film by tubular film extrusion of a polypropylene resin composition comprising syndiotactic polypropylene and isotactic polypropylene. The blend is made by melt blending syndiotactic polypropylene and isotactic polypropylene.

U.S. Pat. No. 5,444,125, issued Aug. 22, 1995 to Tomita et al. discloses laminated olefin polymers obtained by introducing an amino group, into the terminal unsaturated isotactic or syndiotactic alpha-olefin polymer having an olefinic unsaturated bond at its terminus.

U.S. Pat. No. 5,455,305, issued Oct. 3, 1995 to Galambos discloses yarn made from blends of syndiotactic polypropylene and isotactic polypropylene.

U.S. Pat. No. 5,459,117, issued Oct. 17, 1995 to Ewen discloses doubly-conformationally locked, stereorigid catalysts for the preparation of tactiospecific polymers. Specifically, a double-conformationally locked metallocene, i.e., the chain-end is locked conformationally by two sterically different substituents at the distal ring carbon atoms of the cyclopentadienyl radical. The catalysts can be designed to impart any degree of tacticity to the resulting polymers by varying the substituents at the distal ring carbon atoms.

There is still a need in the art for bicomponent fibers of isotactic polypropylene and syndiotactic polypropylene.

These and other needs in the art will become apparent to those of skill in the art upon review of this specification, including its drawings and claims.

SUMMARY OF THE INVENTION

It is an object of the present invention to provide for bicomponent fibers of isotactic polypropylene and syndiotactic polypropylene.

These and other objects of the present invention will become apparent to those of skill in the art upon review of this specification, including its drawings and claims.

According to one embodiment of the present invention, there is provided a bicomponent fiber having a first component and a second component, wherein the first component and the second component are fused together, and wherein the first component comprises isotactic polypropylene and the second component comprises syndiotactic polypropylene.

According to another embodiment of the present invention, there is provided a method of making a biocomponent fiber, comprising extruding a first fiber component and a second component, and then fusing together the first component and the second component, wherein the first component comprises isotactic polypropylene and the second component comprises syndiotactic polypropylene.

DETAILED DESCRIPTION OF THE INVENTION

Figure 1:
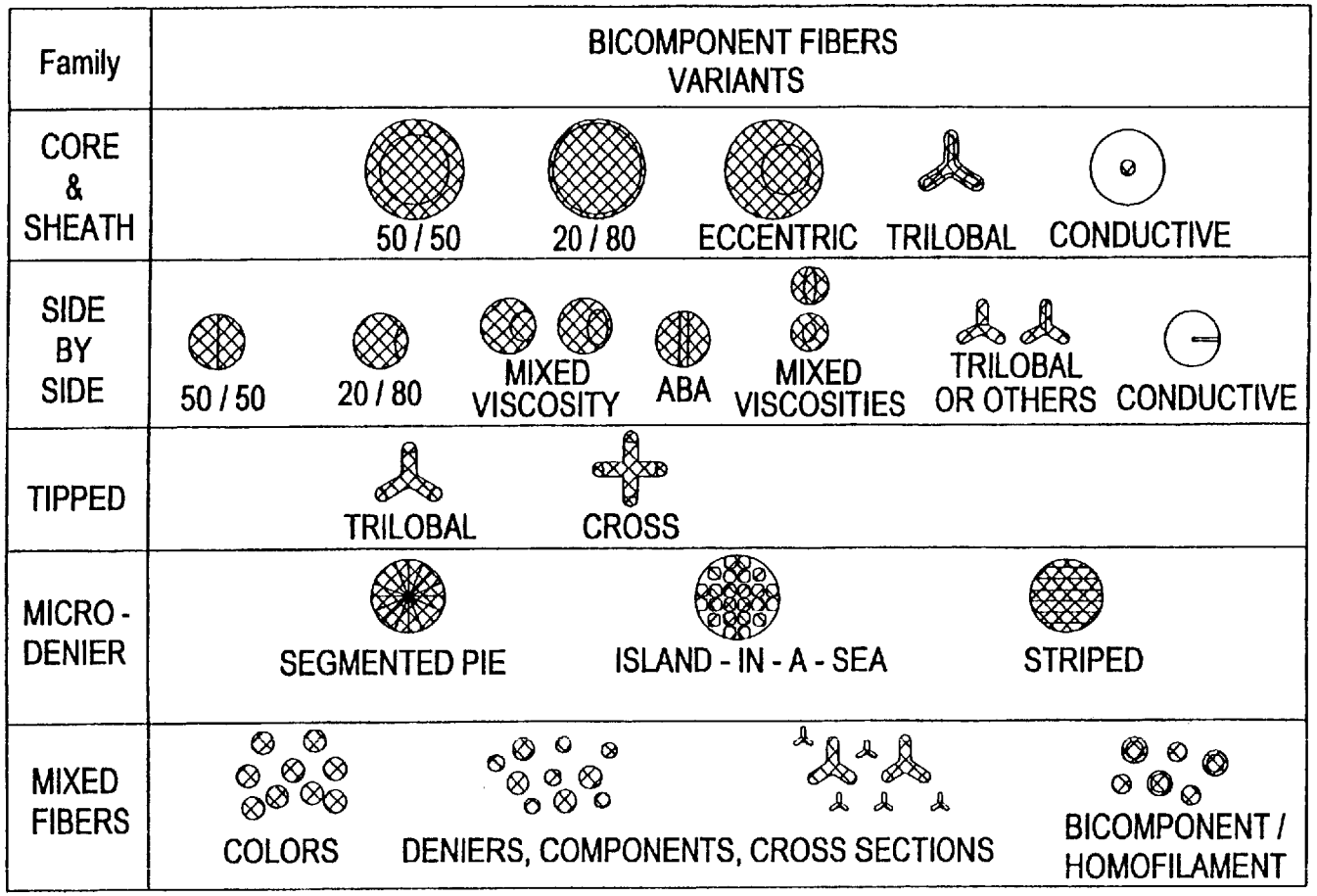
FIG. 1 is an illustration of various types of bicomponent fibers useful in the present invention.

The fibers of the present invention are bicomponent fibers of isotactic polypropylene and syndiotactic polypropylene.

The isotactic structure is typically described as having the methyl groups attached to the tertiary carbon atoms of successive monomeric units on the same side of a hypothetical plane through the main chain of the polymer, e.g., the methyl groups are all above or all below the plane. Using the Fischer projection formula, the stereochemical sequence of isotactic polypropylene is described as follows:

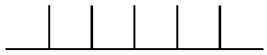

Another way of describing the structure is through the use of NMR spectroscopy. Bovey's NMR nomenclature for an isotactic pentad is . . . mmmm . . . with each "m" representing a "meso" dyad or successive methyl groups on the same side in the plane. As known in the art, any deviation or inversion in the structure of the chain lowers the degree of isotacticity and crystallinity of the polymer.

In contrast to the isotactic structure, syndiotactic polymers are those in which the methyl groups attached to the tertiary carbon atoms of successive monomeric units in the chain lie on alternate sides of the plane of the polymer. Using the Fischer projection formula, the structure of a syndiotactic polymer is designated as:

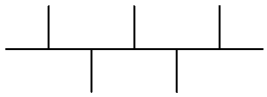

In NMR nomenclature, this pentad is described as . . . rrrr . . . in which each "r" represents a "racemic" dyad, i.e., successive methyl group on alternate sides of the plane. The percentage of r dyads in the chain determines the degree of syndiotacticity of the polymer. Syndiotactic polymers are crystalline and, like the isotactic polymers, are insoluble in xylene. This crystallinity distinguishes both syndiotactic and isotactic polymers from an atactic polymer which is soluble in xylene.

Suitable isotactic polypropylenes utilized in the blends of the present invention, and methods of making such isotactic polypropylenes, are well known to those of skill in the polyolefin art. Examples of a suitable isotactic polypropylenes and methods of and catalysts for their making can be found in U.S. Pat. Nos. 4,794,096 and 4,975,403.

Preferably, the isotactic polypropylene utilized in the present invention comprises at least 80 percent isotactic molecules. More preferably, the isotactic polypropylene utilized in the present invention comprises at least 85 percent isotactic molecules, even more preferably at least 90 percent isotactic molecules, and still more preferably at least about 95 percent isotactic molecules. Most preferably the isotactic polypropylene utilized in the present invention comprises substantially isotactic molecules.

The still more preferred isotactic polypropylenes utilized in the present invention generally comprise in the range of about 80 to about 99 percent isotactic molecules, more preferably in the range of about 90 to about 99 percent isotactic molecules, and most preferably in the range of about 95 to about 98 percent isotactic molecules.

The isotactic polypropylenes utilized in the present invention generally have a melt flow index in the range of about 4 to about 1800. Preferably, for use in woven applications, the isotactic polypropylenes will have a melt flow index in the range of about 4 to about 40, more preferably in the range of about 8 to about 30. Preferably, for use in non-woven applications, the isotactic polypropylenes will have a melt flow index in the range of about 30 to about 1800.

The syndiotactic polypropylenes suitable for use in the blends of the present invention, and methods of making such a syndiotactic polypropylenes, are well known to those of skill in the polyolefin art. Examples of suitable syndiotactic polypropylenes and methods of and catalysts for their making can be found in U.S. Pat. Nos. 3,258,455, 3,305,538, 3,364,190, 4,852,851, 5,155,080, 5,225,500, 5,334,677 and 5,476,914, all herein incorporated by reference.

Preferably, the syndiotactic polypropylene utilized in the present invention comprises at least 70 percent syndiotactic molecules. More preferably, the syndiotactic polypropylene utilized in the present invention comprises at least 75 percent syndiotactic molecules, even more preferably at least 80 percent syndiotactic molecules, and still more preferably at least about 83 percent syndiotactic molecules. Most preferably the syndiotactic polypropylene utilized in the present invention comprises substantially syndiotactic molecules.

The still more preferred syndiotactic polypropylenes utilized in the present invention generally comprise in the range of about 83 to about 95 percent syndiotactic molecules, more preferably in the range of about 85 to about 95 percent syndiotactic molecules, and most preferably in the range of about 89 to about 95 percent syndiotactic molecules.

The syndiotactic polypropylenes utilized in the present invention generally have a melt flow index in the range of about 4 to about 1000. Preferably, for use in woven applications, the syndiotactic polypropylenes will have a melt flow index in the range of about 4 to about 40, more preferably in the range of about 8 to about 8. Preferably, for use in non-woven applications, the syndiotactic polypropylenes will have a melt flow index in the range of about 30 to about 1000.

The bicomponent fibers of the present invention comprise an isotactic polypropylene component and a syndiotactic polypropylene component, with each component fused to the other along the fiber axis.

The bicomponent fibers of the present invention may be any type of bicomponent fiber. Non-limiting examples of bicomponent fibers which may be utilized in the present invention include core and sheath, side-by-side, tipped, microdenier, and mixed fibers. Referring now to FIG. 1, there is shown non-limiting examples of bicomponent fiber useful in the present invention.

The components of a bicomponent fiber can be joined in a symmetric or an asymmetric arrangement. Basically, the spinning of bicomponent fibers involves coextrusion of two different polymers to form several single filaments. Bicomponent fiber extrusion equipment is utilized to bring together the two component melt streams in a desired predetermined arrangement. Such bicomponent fiber extrusion equipment is well known in the art, and any suitable equipment may be utilized.

Figure 2A:
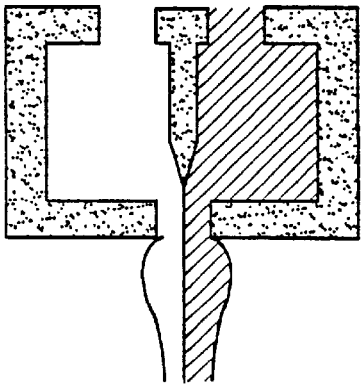
FIGS. 2A and 2B is an illustration of manifolds used for merging of the components in the side-by-side and core-sheath arrangement, respectively.
Figure 2B:
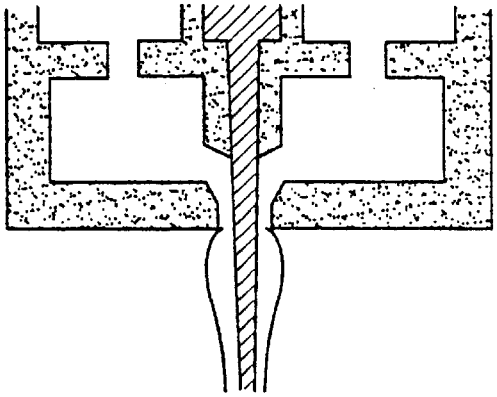

Referring now to FIGS. 2A and 2B, there is shown examples of manifolds used for merging of the components in the side-by-side and core-sheath arrangement, respectively.

The shape of the line between the two components can be controlled by adjusting the separating element in the manifold in relation to the spinnerette hole. The ratio of the components in the fiber can be adjusted by controlling the speed of the metering pump for each component. The spin manifolds used for bicomponent spinning are more complicated than those used for one component spinning. Such manifolds are well known in the art, and any suitable manifold may be utilized in the practice of the present invention.

Figure 3:
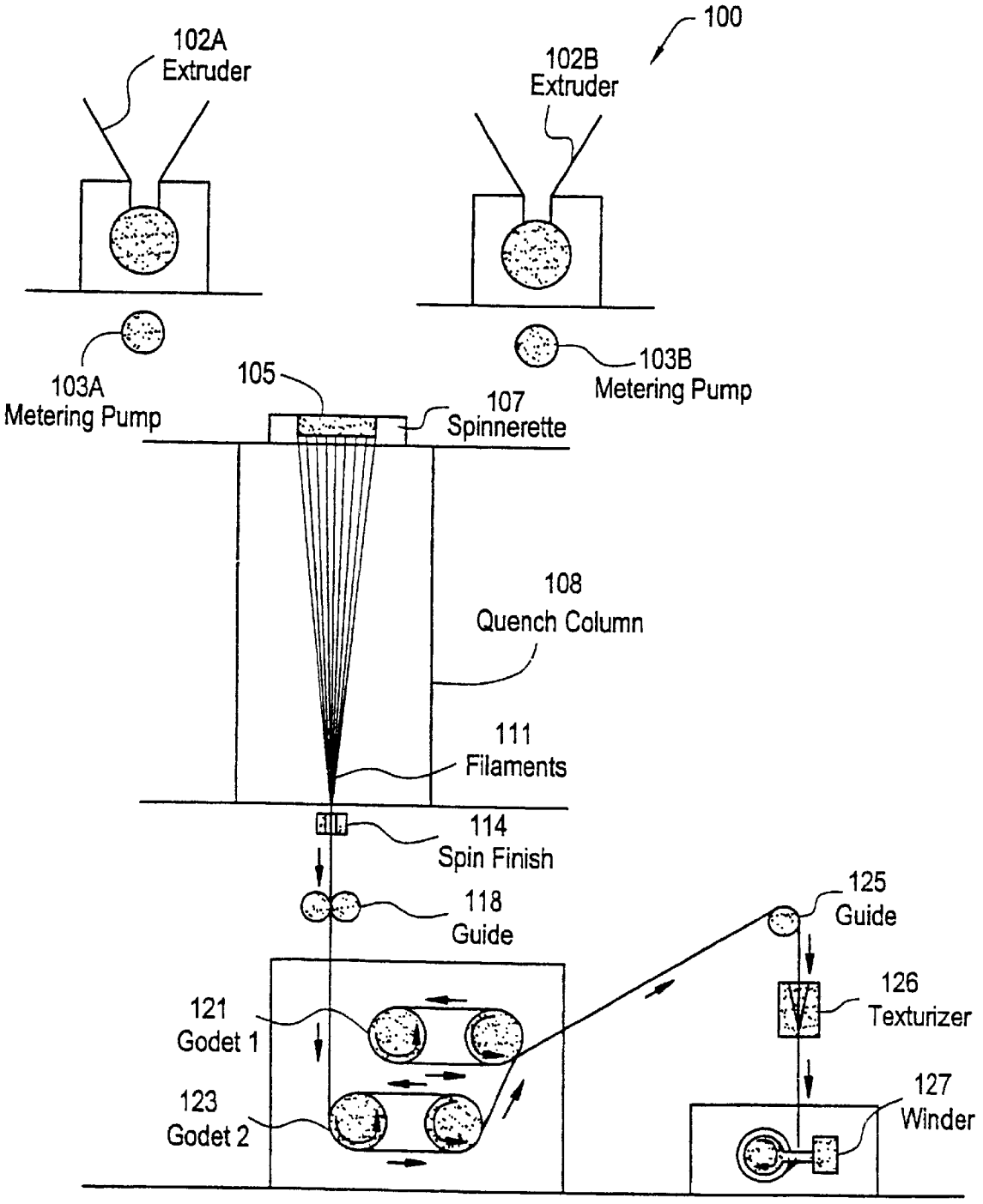
FIG. 3 is a schematic representation of a fiber spinning machine 100.

For example, referring now to FIG. 3, there is shown a schematic representation of a fiber spinning machine 100. Fiber spinning machines are well known in the art, the present invention is not meant to be limited to any particular fiber spinning machine. As shown in FIG. 3, two different polymers are melted in two separate extruders 102A and 102B before being pumped through separate metering pumps 103A and 103B before being pumped into bicomponent spinning manifold 105. The filaments 111 are then formed by passage through spinnerette 107 and solidified by passage through quench column 108. Filaments 111 then travel through spin finish 114', through guide 118, over godets 121 and 122, past guide 125, through texturizer 126 and onto winder 127.

The fibers of the present invention are believed to be useful as substitutes for prior art fibers. Non-limiting examples of suitable applications include carpets, geotextiles and fabrics.

The fibers of the present invention may optionally also contain conventional ingredients as are known to those of skill in the art. Non-limiting examples of such conventional ingredients include antiblocking agents, antistatic agents, antioxidants, blowing agents, crystallization aids, colorants, dyes, flame retardants, fillers, impact modifiers, mold release agents, oils, other polymers, pigments, processing agents, reinforcing agents, stabilizers, UV resistance agents, antifogging agents, wetting agents and the like.

EXAMPLES

The following examples are provided merely to illustrate the present invention, and are not intended to limit the claims of the invention.

Example 1

Figure 4:
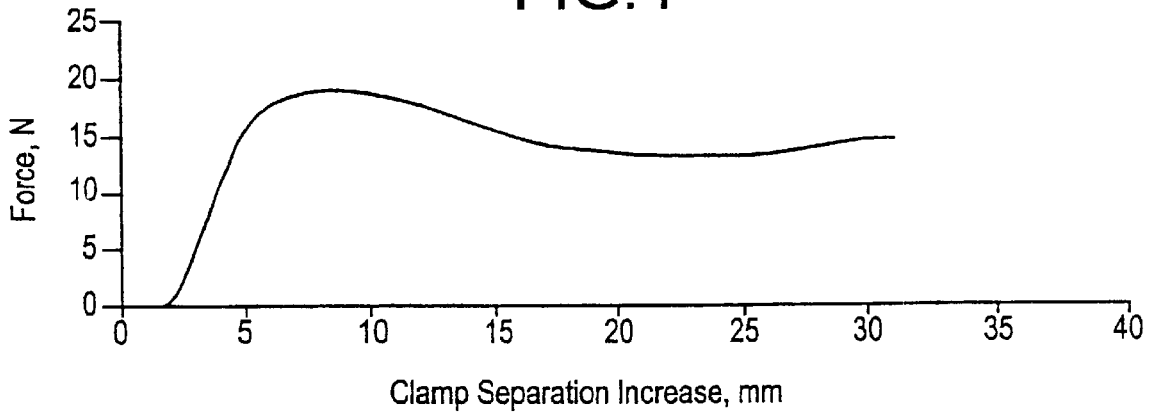
FIG. 4 is a graph of results for Example 1 for five samples carried out at a sealing temperature of 130° C.

To test the adhesion between two polymers, iPP and sPP, film samples of both the polymers are sealed in a Theller Heatsealing System and separated by clamping each end of the film at a rate of 30 cm/min. The force response is an indication of the bonding between the two polymers. Results are shown in FIG. 4 for five samples carried out at a sealing temperature of 130° C. The pairs did not peal off from the seal. The average maximum force was calculated as 21 N.

Example 2

Figure 5:
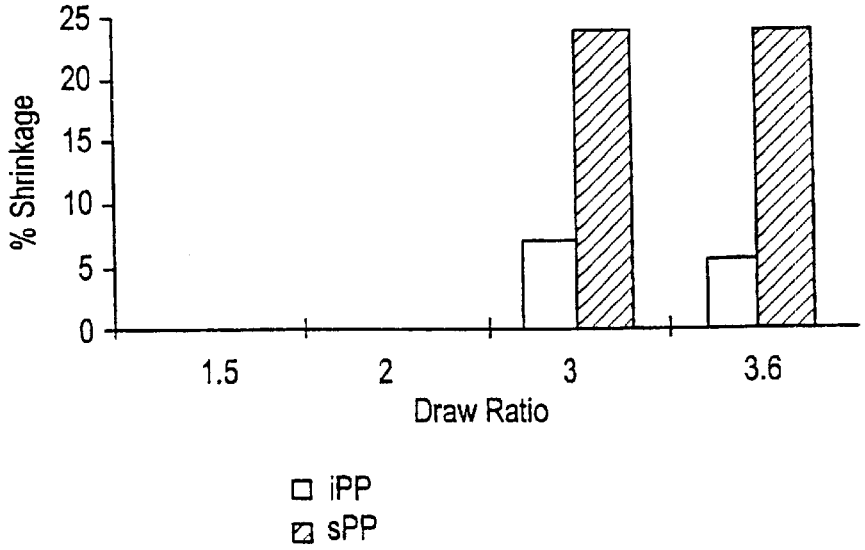
FIG. 5 is a graph of results for Example 2 showing shrinkage characteristics of polymers at 130° C. at draw ratios of 3 and 3.6.

Shrinkage tests were performed on the sPP and iPP fibers produced individually. FIG. 5 shows shrinkage characteristics of the two polymers at 130° C. at draw ratios of 3 and 3.6. The difference in shrinkage characteristics of the iPP and sPP fiber will allow for crimping of the fiber. For example, if a bicomponent fiber is produced with sPP as the core and iPP as the sheath, then sPP with its high shrinkage will tend to pull the iPP in turn enhancing the crimp of the fiber.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A bicomponent fiber comprising a first component and a second component, wherein the first component and the second component are fused together, and wherein the first component and the second component comprise different materials which are selected from isotactic polypropylene and syndiotactic polypropylene.

2. The fiber of claim 1 wherein the first component comprises a core of the fiber, and the second component comprises a sheath of the fiber.

3. The fiber of claim 2 wherein the core comprises in the range of about 20 to about 80 weight percent of the fiber and the sheath in the range of about 80 to about 20 weight percent of the fiber, based on the weight of the core and the sheath.

4. The fiber of claim 2 wherein the first component and the second component are of different melt flow indices.

5. The fiber of claim 2 wherein the first component and the second component are of different colors.

6. The fiber of claim 1 wherein the first component comprises a body portion of the fiber having members extending outwardly from the body, and wherein the second component comprises a tip portion of each member.

7. The fiber of claim 6 wherein the body has a trilobal cross-sectional shape comprising three members.

8. The fiber of claim 6 wherein the body has a cross-shaped cross-sectional shape comprising four members.

9. The fiber of claim 6 wherein the first component and the second component are of different melt flow indices.

10. The fiber of claim 6 wherein the first component and the second component are of different colors.

11. The fiber of claim 1 wherein the first component comprises a body portion of the fiber, and wherein the second component comprises a multiplicity of fibrils distributed in the body.

12. The fiber of claim 11 wherein the first component and the second component are of different melt flow indices.

13. The fiber of claim 11 wherein the first component and the second component are of different colors.

* * * * *

UNITED STATES PATENT AND TRADEMARK OFFICE

CERTIFICATE OF CORRECTION

PATENT NO. : 6,395,392 B1
DATED : May 28, 2002
INVENTOR(S) : Mohan R. Gownder

It is certified that error appears in the above-identified patent and that said Letters Patent is hereby corrected as shown below:

Title page,
Item [73], Assignee, should read -- Fina Technology, Inc.
Dallas, Texas --

Signed and Sealed this

Eleventh Day of November, 2003

JAMES E. ROGAN
*Director of the United States Patent and Trademark Office*